US005844183A

United States Patent [19]

Tseng

[11] Patent Number: 5,844,183

[45] Date of Patent: Dec. 1, 1998

[54] BUTTON SWITCH

[76] Inventor: Ming-I Tseng, P.O. Box 82-144, Taipei, Taiwan

[21] Appl. No.: 856,762

[22] Filed: May 18, 1997

[51] Int. Cl.[6] ..... H01H 9/16; H01H 21/00

[52] U.S. Cl. ..... 200/6 R; 200/308; 200/339

[58] Field of Search ..... 200/6 R–6 C, 200/405, 408, 410, 416, 417, 437, 438, 440, 442, 447–449, 451–453, 457–459, 461–468, 553, 560, 308, 309, 339

[56] References Cited

U.S. PATENT DOCUMENTS

| | | | |
|---|---|---|---|
| 3,311,716 | 3/1967 | Carlson | 200/6 R |
| 3,995,132 | 11/1976 | Piber | 200/315 |
| 4,751,467 | 6/1988 | Sorenson et al. | 200/6 BA |
| 5,008,503 | 4/1991 | Stuhlmacher | 200/308 |
| 5,038,008 | 8/1991 | Pommier | 200/339 |

*Primary Examiner*—Michael A. Friedhofer
*Attorney, Agent, or Firm*—A & J

[57] ABSTRACT

A button switch includes: a housing provided with two resilient members at two opposite lateral sides thereof and two aligned holes at another two opposite sides thereof, a first blade extending upwardly into the housing and pivotally connected with an intermediate portion of a rocking plate; a second blade being a L-shaped member extending upwardly into the housing and engageable with the rocking plate; a button provided with two protuberances adapted to engage with the aligned holes of the housing, a projection at a bottom thereof, and a recess at an end thereof, the recess being provided with a protrusion at one side thereof and a through hole at another side thereof; a spring mounted between the first blade and the projection of the button; and an indicating member having a cavity at a bottom and a protuberance at a top, the indicating member being fitted within the recess of the button with the cavity and protuberance engaged with the protrusion and through hole.

1 Claim, 2 Drawing Sheets

BUTTON SWITCH

BACKGROUND OF THE INVENTION

1. Field of the Invention

This invention relates to an improved button switch which can clearly illustrate whether the switch is turned on or off.

2. Field of the Invention

It has been found that the conventional button switch (see FIGS. 3 and 4) utilizes a circle to indicate the ON position and a straight line the OFF position. However, as the indicating marks are printed on the switch, they are easily erased thereby causing much inconvenience in use. Hence, a switch provided with a pilot light has been developed to eliminate this drawback. Nevertheless, once the pilot light does not work properly, it will also cause confusion in controlling the switch.

Therefore, it is an object of the present invention to provide an improved button switch which can obviate and mitigate the above-noted drawback.

SUMMARY OF THE INVENTION

This invention is related to an improved button switch.

It is the primary object of the present invention to provide a button switch which can clearly illustrate whether the switch is turned on or off.

It is another object of the present invention to provide a button switch which utilizes an indicating member to show the condition of the switch.

It is still another object of the present invention to provide a button switch which is simple in construction.

It is still another object of the present invention to provide a button switch which is fit for practical use.

It is a further object of the present invention to provide a button switch which is facile to assemble.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
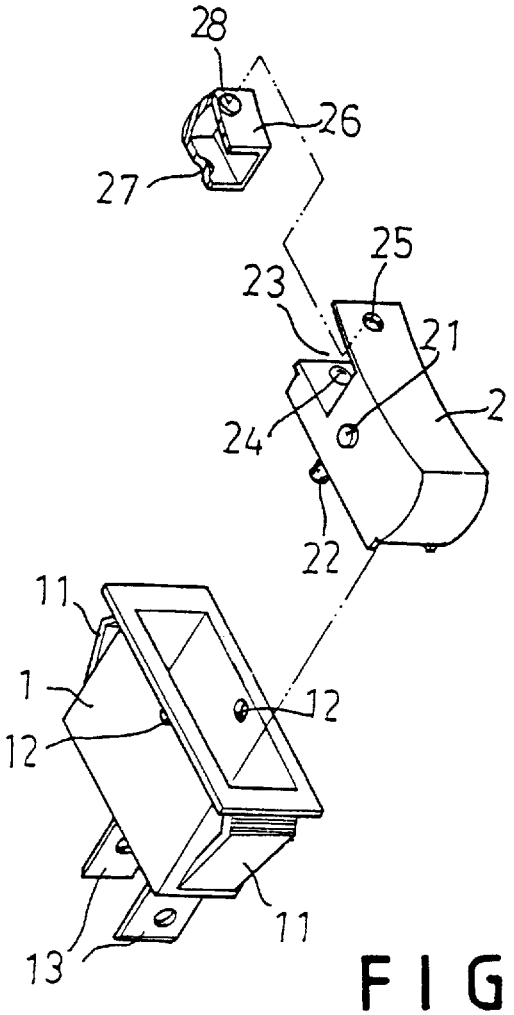
FIG. 1 an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
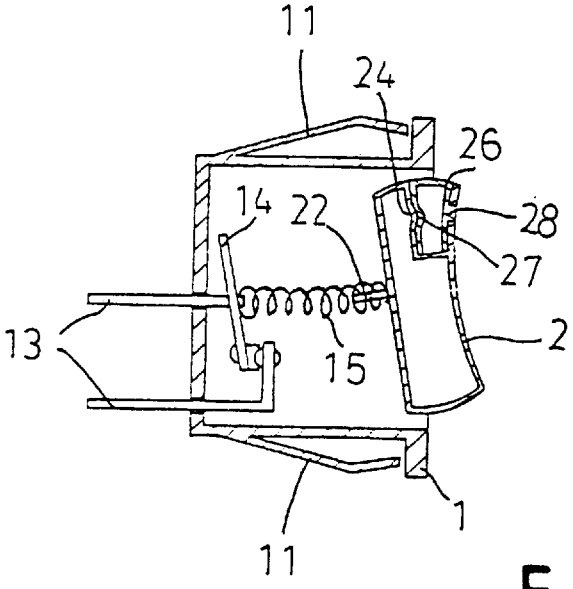
FIG. 2 is a sectional view of the present invention.
Figure 3:
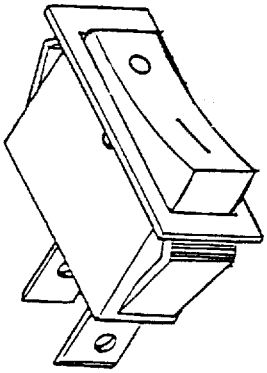
PRIOR ART FIG. 3
FIGS. 3 and 4 illustrate a prior art button switch at ON and OFF conditions.
Figure 4:
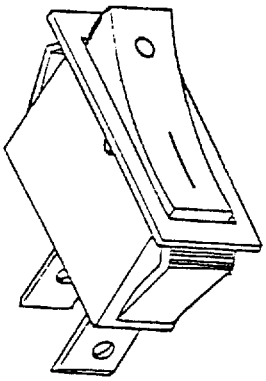
PRIOR ART FIG. 4

Referring to FIGS. 1 and 2, the button switch according to the present invention mainly comprises a housing 1 and a button 2.

The housing 1 is open at the top and provided with two resilient members 11 at two opposite lateral sides. The other two opposite sides of the housing 1 is formed with two aligned holes 12. Two blades 13 extend upwardly into the housing 1. One of the two blades 13 is a L-shaped member, while the other is a rectangular member connected with the intermediate portion of a rocking plate 14 which may be turned to contact the inner end of the L-shaped blade 13. The inner end of the rectangular blade 13 is connected with an end of a spring 15.

The button 2 is provided with two protuberances 21 at two opposite sides, a projection 22 at the bottom, and a recess 23 at an end. The recess 23 is provided with a protrusion 24 at its one side and a through hole 25 at its the other side. An indicating member 26 having a cavity 27 at its bottom and a protuberance 26 at its top is fitted within the recess 23, with the cavity 27 and protuberance 28 of the former engaged with the protrusion 24 and through hole 25 of the latter.

When in assembly, the button 2 is fitted into the housing 1, with the protuberances 21 of the former engaged with the holes 12 of the latter. In the meantime, the other end of the spring 15 is engaged with the projection 22 of the button 2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A button switch comprising:

a housing provided with two resilient members at two opposite lateral sides thereof and two aligned holes at another two opposite sides thereof;

a first blade extending upwardly into said housing and pivotally connected with an intermediate portion of a rocking plate;

a second blade being a L-shaped member extending upwardly into said housing and engageable with said rocking plate;

a button provided with two protuberances adapted to engage with said aligned holes of said housing, a projection at a bottom thereof, and a recess at an end thereof, said recess being provided with a protrusion at one side thereof and a through hole at another side thereof;

a spring mounted between said first blade and said projection of said button; and an indicating member having a cavity at a bottom and a protuberance at a top, said indicating member being fitted within said recess of said button with said cavity and protuberance engaged with said protrusion and through hole.

* * * * *